US005461896A

United States Patent [19]

Abbey, III et al.

[11] Patent Number: 5,461,896

[45] Date of Patent: Oct. 31, 1995

[54] AUTOMATED CHANGEOVER TUBE MILL

[75] Inventors: Nelson D. Abbey, III, Monclova; Richard L. Dreier, Northwood; Susan J. Taber, Gibsonburg, all of Ohio

[73] Assignee: Abbey Etna Machine Company, Perrysburg, Ohio

[21] Appl. No.: 198,479

[22] Filed: Feb. 18, 1994

[51] Int. Cl.[6] ..... B21B 31/10

[52] U.S. Cl. ..... 72/181; 72/226; 72/239

[58] Field of Search ..... 72/181, 226, 239, 72/238, 176

[56] References Cited

U.S. PATENT DOCUMENTS

| | | | |
|---|---|---|---|
| 1,833,376 | 11/1931 | Simmons | 72/226 |
| 3,323,341 | 6/1967 | Chang . | |
| 3,451,244 | 6/1969 | Stover | 72/239 |
| 3,472,053 | 10/1969 | Chang . | |
| 3,583,195 | 6/1971 | Sherwood | 72/239 |
| 3,665,746 | 5/1972 | Eibe | 72/239 |
| 3,777,531 | 12/1973 | McClain | 72/226 |
| 4,724,695 | 2/1988 | Stoehr . | |
| 5,016,806 | 5/1991 | Yapp et al. . | |

FOREIGN PATENT DOCUMENTS

| | | | |
|---|---|---|---|
| 2436069 | 10/1975 | Germany | 72/181 |
| 68224 | 4/1982 | Japan | 72/181 |
| 47025 | 3/1984 | Japan | 72/181 |
| 30315 | 1/1990 | Japan | 72/239 |
| 161919 | 6/1993 | Japan | 72/226 |

*Primary Examiner*—Daniel C. Crane
*Attorney, Agent, or Firm*—Donald R. Fraser

[57] ABSTRACT

An automated system for exchanging components of a continuous seam-welded tube mill to change from production of one tubular product to another. The components to be changed are mounted upon sub-base units adapted to be removably affixed to a fixed mill base. Alternate sets of changeable mill units mounted on duplicate sub-base sections are provided for off line tooling change and setup. Changeover modules are provided alongside and spaced from the mill base. Bridging roll units are extendible to span the space between the mill bases and the changeover modules, and push-pull units are incorporated in the changeover modules to shift the sub-base sections from the mill base to the changeover module and the previously retooled duplicate sub-base sections from the changeover modules into operative position on the mill bases.

13 Claims, 11 Drawing Sheets

AUTOMATED CHANGEOVER TUBE MILL

BACKGROUND OF THE INVENTION

1. Field of the Invention

The present invention pertains generally to a mill for the manufacture of continuous seam-welded tubes or pipes, and more particularly to an automated system for rapidly changing such a mill from the production of one size or shape of tube to production of tube of another and different size or shape.

2. Description of the Prior Art

In accordance with a well known process for producing seam-welded tubes, a continuous strip or skelp is advanced through forming apparatus comprising a series of forming rolls and progressively deformed into a tubular form having an open, longitudinally extending seam. The tubular form then advances through a welding station wherein the adjacent longitudinal edges are urged together and joined by a suitable welding process. The weld tube may then have the raised weld bead removed from its surfaces and, after passing through a cooling zone, pass through a series of shaping and sizing rollers whereby it is formed to the final configuration and size. The advancing continuous tube is then severed by means of a travelling cutting unit into individual sections of a predetermined length.

The machines are designed to be capable of conversion to production of various sizes and cross-sectional configurations of tube. As will be readily appreciated, such machines are massive precision machines representing a considerable capital investment. Heretofore in converting from production of tubing of one size or shape to another, the line was shut down and the various components were individually removed and replaced by components required for production of the next product. The replacement components then had to be properly set and adjusted on the line before production could resume. This entire changeover routine could consume a considerable period of time, typically five or six hours or more. The changeover thus involves a considerable expenditure in time and money, and an extensive loss of production. As a result it becomes necessary to maintain unduly large inventories of finished products, contrary to the current trend toward maintaining minimum inventory and frequently switching from production of one product to another.

SUMMARY OF THE INVENTION

In accordance with the present invention the aforementioned deficiencies of the prior art devices are overcome by providing a tube mill utilizing an automated procedure for exchanging components of the mill to change from production of one tubular product to another. The units of the mill which are changed during the changeover procedure are mounted on removable sub-base sections adapted to be carried on a fixed mill base. A complete duplicate set of mill units mounted on corresponding movable sub-base sections is provided for off line tooling change and set-up.

A quick changeover module is provided alongside and spaced from the permanent mill base for each sub-base section. Each changeover module includes a transfer table having bridging roll units extendible to span the gap between the mill base and the transfer table. Push-pull modules are provided for each transfer table for removing the sub-base units from the mill line to the transfer tables and installing the duplicate set of sub-base units in the mill line.

A side storage table is positioned adjacent the transfer table and parallel to the mill base, and a changeover rack is positioned adjacent the transfer table directly opposite the mill base. Lifting rollers are incorporated in the transfer table and a push-pull module is provided for temporarily transferring the sub-base unit removed from the mill line to the side storage table so as to permit transfer of the duplicate sub-base unit from the changeover rack to the mill base. The removed sub-base unit is then transferred back to the transfer table, and thereafter to the changeover rack for an off-line tooling change.

Each of the driven mill stands is coupled to the drive gear boxes of the mill by automatic quick connect-disconnect couplings. Drive stand housing assemblies mounted on the mill base carry spring-loaded female type coupling units interconnected through universal joints to mill drive gear boxes. Mating male coupling units on the driven mill stands carried by the movable sub-bases automatically engage with and disengage from corresponding ones of the female coupling units as the sub-bases are moved into and out of operative position on the mill base.

BRIEF DESCRIPTION OF THE DRAWINGS

In the drawings, wherein like numerals are employed to designate like parts throughout the same.

DESCRIPTION OF THE PREFERRED EMBODIMENT

Figure 1:
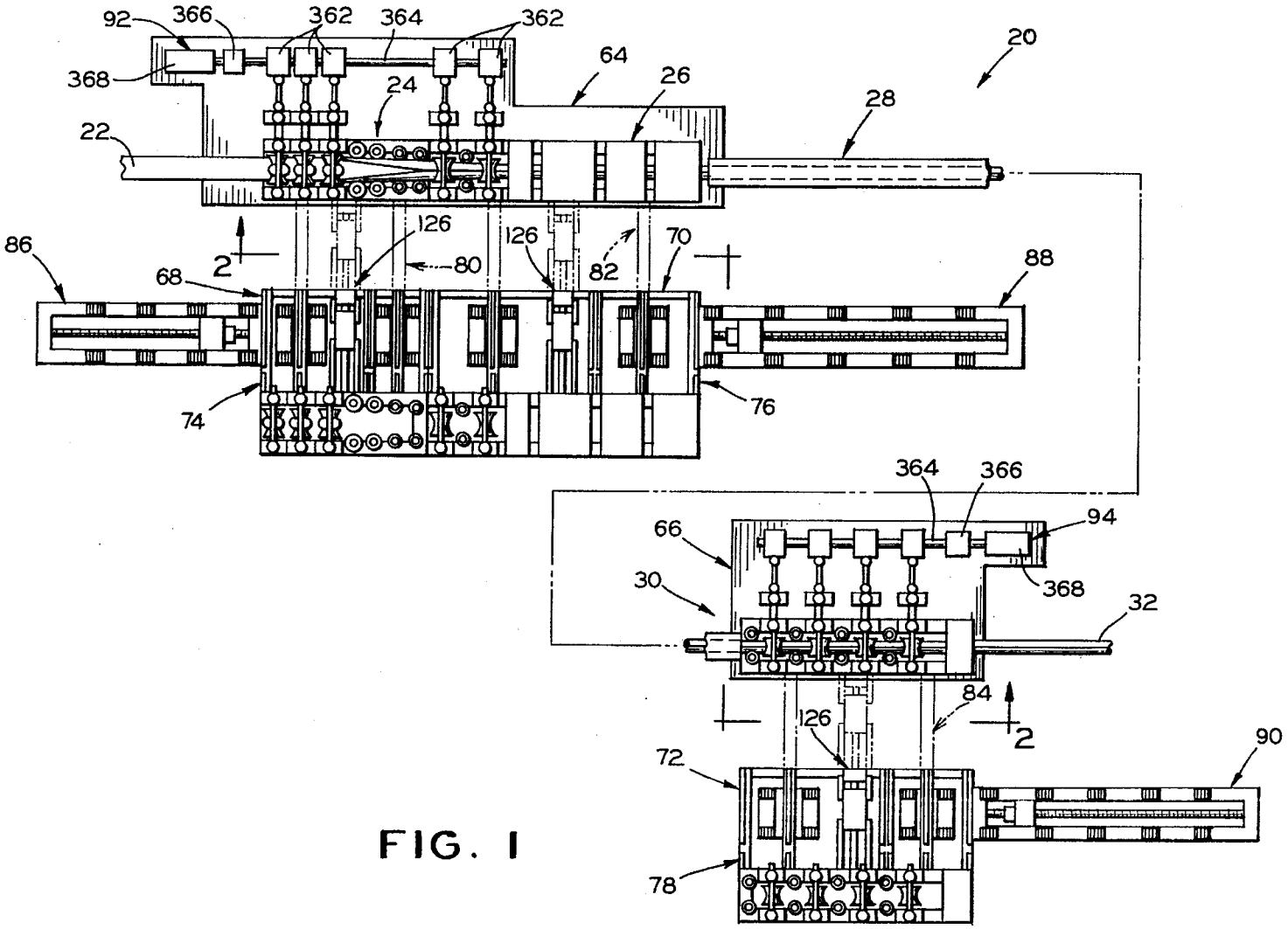
FIG. 1 is a top plan view of a tube mill embodying the invention.
Figure 2:
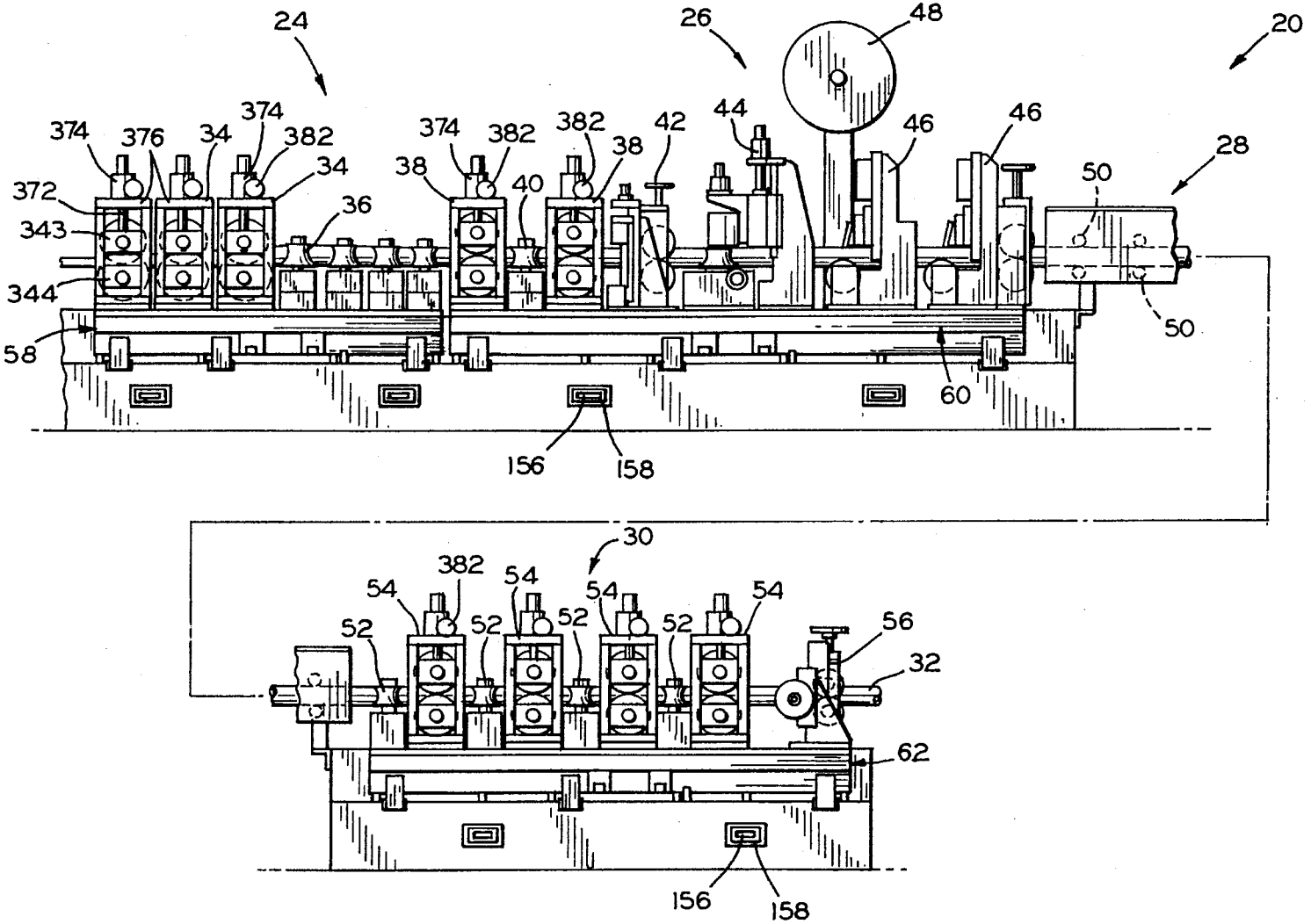
FIG. 2 is an elevational view taken substantially along line 2—2 of FIG. 1.

With reference to the drawings, and particularly to FIGS. 1 and 2, there is shown generally at 20 an automated tube mill changeover system embodying the invention. In such tube mills a metal strip or skelp 22 is continuously withdrawn from a supply (not shown) and advanced successively through a forming section 24, a welding section 26, a cooling section 28 and a sizing section 30 to produce a continuous seam-welded metal tube or pipe 32. Thereafter the finished tube or pipe is separated into individual segments of predetermined length. Such sections, per se, are conventional in the art as disclosed, for example, in U.S. Pat. Nos. 5,148,960 and 5,192,013, to which reference may be had for a further description.

The forming section 24 more particularly comprises a series of forming stands 34 mounting opposed driven breakdown rolls, and cluster units 36 of forming rolls as will be hereinafter described. The welding section 26 typically includes a pair of fin stands 38, an intermediate side closer unit 40, a seam guide unit 42, a welder 44, a pair of tandem weld bead scarfing units 46, an associated chip winder 48, and a working and traction unit 48. The cooling section 28 typically comprises an open type cooling trough along which pairs of upper and lower Vee-type rolls 50 convey the tube. Manifolds above the pass line (not shown) spray coolant onto the tube 32 to cool the seam following welding. The sizing section 30 includes a series of alternating side closer units 52 and sizing stands 54 through which the tube passes to be formed to the proper size and configuration. Following its exit from the final sizing stand 54, the tube passes through a so-called turkshead unit 56 for straightening prior to being severed into individual sections of desired length.

As will be readily understood, the units through which the skelp 22 passes within the forming, welding and sizing sections 24, 26 and 30, respectively, to be formed into the tube 32 utilize various types of forming elements or rollers which are limited to production of one particular diameter or type of tube. The tube is merely conveyed through the cooling section 28 by Vee-type rollers, so that the cooling section may accommodate tubes of different sizes. Whenever the mill is converted from production of tubing of one diameter or type to another, it is necessary to change the tooling of each of the individual units in at least the forming section 24, the welding section 26 and the sizing section 30. Heretofore, each of these units has been affixed to the permanent mill base. Thus, in order to convert from production of one product size to another it was necessary to shut the mill down while the units were dismantled, reassembled and adjusted on line. Each such change-over resulted in the loss of several hours production time. In accordance with the present invention the units are affixed to sub-bases, adapted to be removably affixed to a permanent mill base. A second set of the units is mounted on duplicate sub-bases, and means is provided for automatically shifting the first set of sub-bases and units thereon to an off-line position for retooling, and shifting the second set of sub-bases and units thereon, which have been retooled and pre-set off-line, into operative positions on the permanent mill base. The actual changeover time during which production is lost is thus reduced to a matter of minutes, generally on the order of five to fifteen minutes.

As will be seen in FIG. 2 the forming, welding and sizing sections 24, 26 and 30 include sub-base frames 58, 60 and 62, respectively, upon which the various units of the forming mill are mounted. Each sub-base frame groups or segregates the mill units to allow for a partial forming, welding and sizing, squaring, or full forming through sizing and/or squaring, automated changeover. To that end each of the sub-base frames 58, 60 and 62 is adapted to be removably affixed to a fixed mill base positioned along the production line. As illustrated in FIG. 1, the forming section 24 and the welding section 26 are adjacent one another, and their sub-base frames 58 and 60 may be carried upon a single fixed mill base unit 64. The sizing section 30 is separated from the welding section by the cooling section 28, and thus its sub-base frame 62 is carried upon a separate mill base unit 66.

For changeover purposes there is provided alongside and spaced laterally from the mill base units for each of the forming, welding and sizing sections, transfer tables identified generally at 68, 70 and 72 (FIG. 1), respectively. The transfer tables include changeover racks 74, 76 and 78, respectively, upon which duplicate sections 24, 26 and 30 are stored for retooling. The transfer tables are positioned some distance from the mill base units so that work may proceed in retooling the sections 24, 26 and 30 off line without interfering with operation of the tube mill.

Retractable bridging roll units 80, 82 and 84 (FIGS. 1, 4 and 14) are extendable from the transfer tables 68, 70 and 72 to the adjacent mill base units for bridging the space between the mill base units and transfer tables, and providing for transfer of the duplicate sections 24, 26 and 30 back and forth therebetween. Side storage tables 86, 88 and 90 extending from the transfer tables 68, 70 and 72, respectively, provide temporary storage for maneuvering the duplicate sets of mill units between the on-line mill bases 64 and 66 and the change-over racks 74, 76 and 78. In order to facilitate automated quick change-over of the mill, automatic connect-disconnect drive systems 92 and 94 are provided on the mill base units 64 and 66, respectively, for coupling drive gear boxes to each of the driven mill stands of the forming, welding and sizing sections.

The sub-base frames 58, 60 and 62 are of generally similar construction, with their dimensions varying as necessary to accommodate the mill units to be mounted thereon. As will be seen in FIGS. 4 and 5, the sub-base frames typically comprise a plurality of spaced transversely extending runner bars 96 and a combined runner and guide bar 98, and a pair of spaced longitudinally extending runner bars 100 interconnected to form a rigid grid base. Tubular support beams 102 extending along the tops of the runner bars 100 of the grid base carry mounting plates 104 upon which base plates 106 of the various units of the forming, welding and sizing sections are removably affixed as by cap screws 108. Angle members 110 affixed along the outer sides of the support beams 102 form channels along the support beams for collecting spent fluid coolant conventionally supplied to the various units of the tube mill. End plates 112 are provided at the opposite ends of the base units for closing off the ends of the collecting channels and the space between the support beams 102. Drain tubes 114 extend transversely through the support beams at spaced locations therealong for permitting fluid coolant collected in the side channels to drain to the interior of the base. Fluid coolant flowing over the various units of the mill is thus collected and drained through the grid base and collected in a longitudinal trough 116 suitably formed in the mill base units 64 and 66 for recirculation through the system.

In order to facilitate transfer of the forming, welding and sizing sections or modules 24, 26 and 30 between the mill base units and their associated transfer tables 68, 70 and 72, roller rails 118 carrying freely rotatable rollers 120 are mounted upon a bed plate 122 on the mill base units. The runner bars 96 ride upon the rollers for moving the sections into and out of operative position upon the mill base units.

As heretofore indicated, the transfer tables 68, 70 and 72 are spaced from the mill base of the production line a sufficient distance, for example on the order of four feet, to permit unobstructed access to the line during production and to provide work space for retooling the alternate sub-base units. The bridging roll units 80, 82 and 84 provide for movement of the sections 24, 26 and 30 back and forth across the gap between the mill bases 64 and 66 and their respective transfer tables 68, 70 and 72. The bridging roll units and the push-pull modules incorporated in the transfer tables are of generally identical construction, differing only in dimensions to accommodate to the different sub-base frames, and hence they will be commonly described herein.

Figure 12:
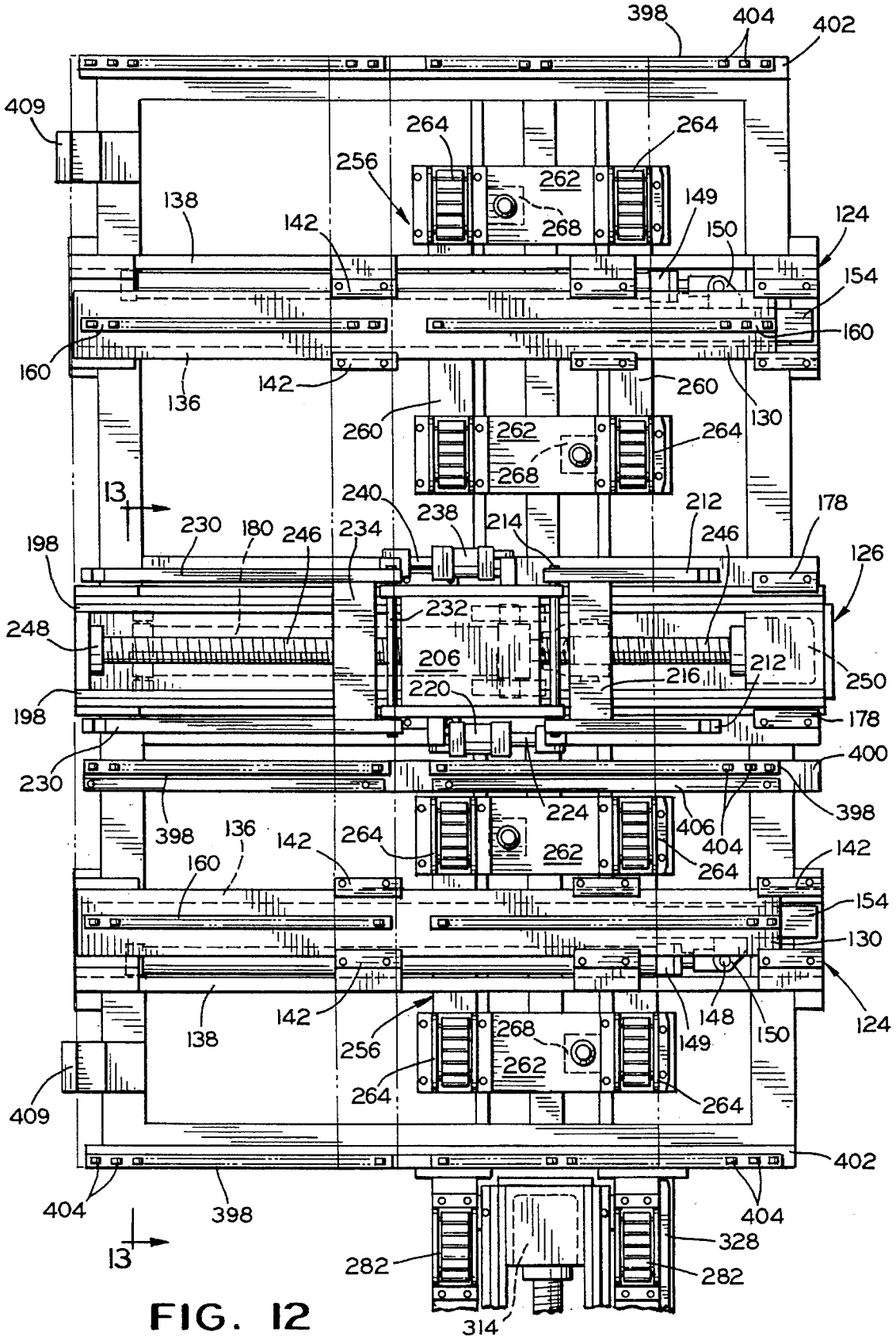
FIG. 12 is a top plan view of a transfer table and changeover rack section of the invention.
Figure 13:
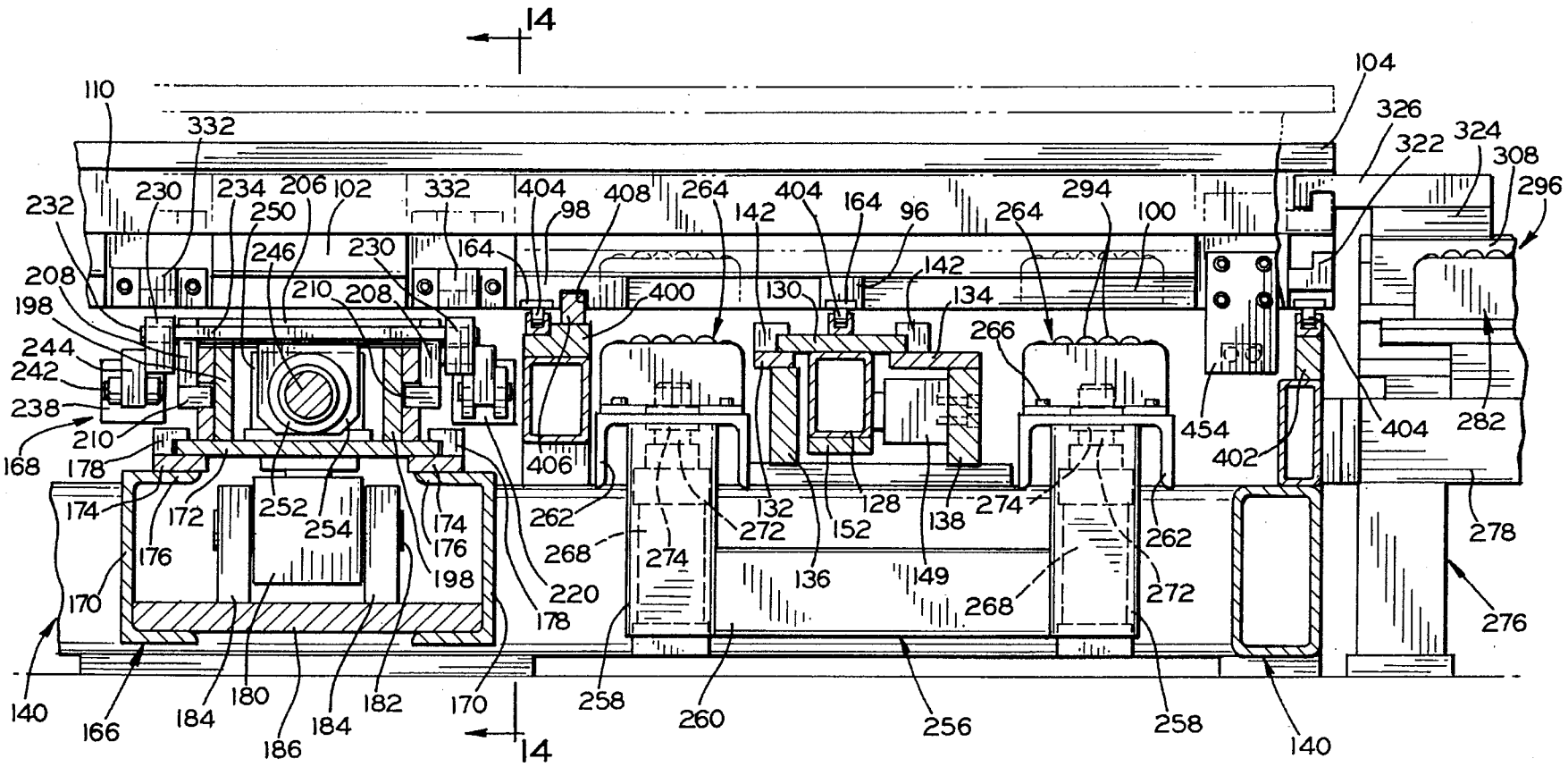
FIG. 13 is an enlarged fragmentary elevational view, partially in section, taken substantially along line 13—13 of FIG. 12.

As best seen in FIGS. 12 and 13 the bridging roll units comprise a spaced pair of bridging arms, shown generally at 124, extendably mounted upon the transfer table. A push-pull module 126 is mounted upon the transfer table intermediate the spaced bridging arms. More particularly, the bridging arms comprise a tubular beam 128 affixed beneath a slide plate 130. The longitudinal marginal edges of the slide plate are carried upon wear plates 132 and 134 carried upon supports 136 and 138, respectively, suitably carried by members of the framework of the transfer table, identified generally at 140. Spaced guide members 142 affixed to the wear plates confine the marginal edges of the slide plate 130 for longitudinal sliding movement along the wear plates.

A fluid actuated cylinder 144 mounted upon the framework of the transfer table as by being affixed to the support 138, includes a piston rod 146 operably connected by means of a pin 148 to a bracket 150 on the side of the beam 128. Thus, by extending or retracting the piston rod 146, the bridging arms 124 can be selectively extended from the transfer table to the mill base to span the gap therebetween as illustrated in broken lines in FIG. 1, and withdrawn to the retracted solid line position.

Figure 4:
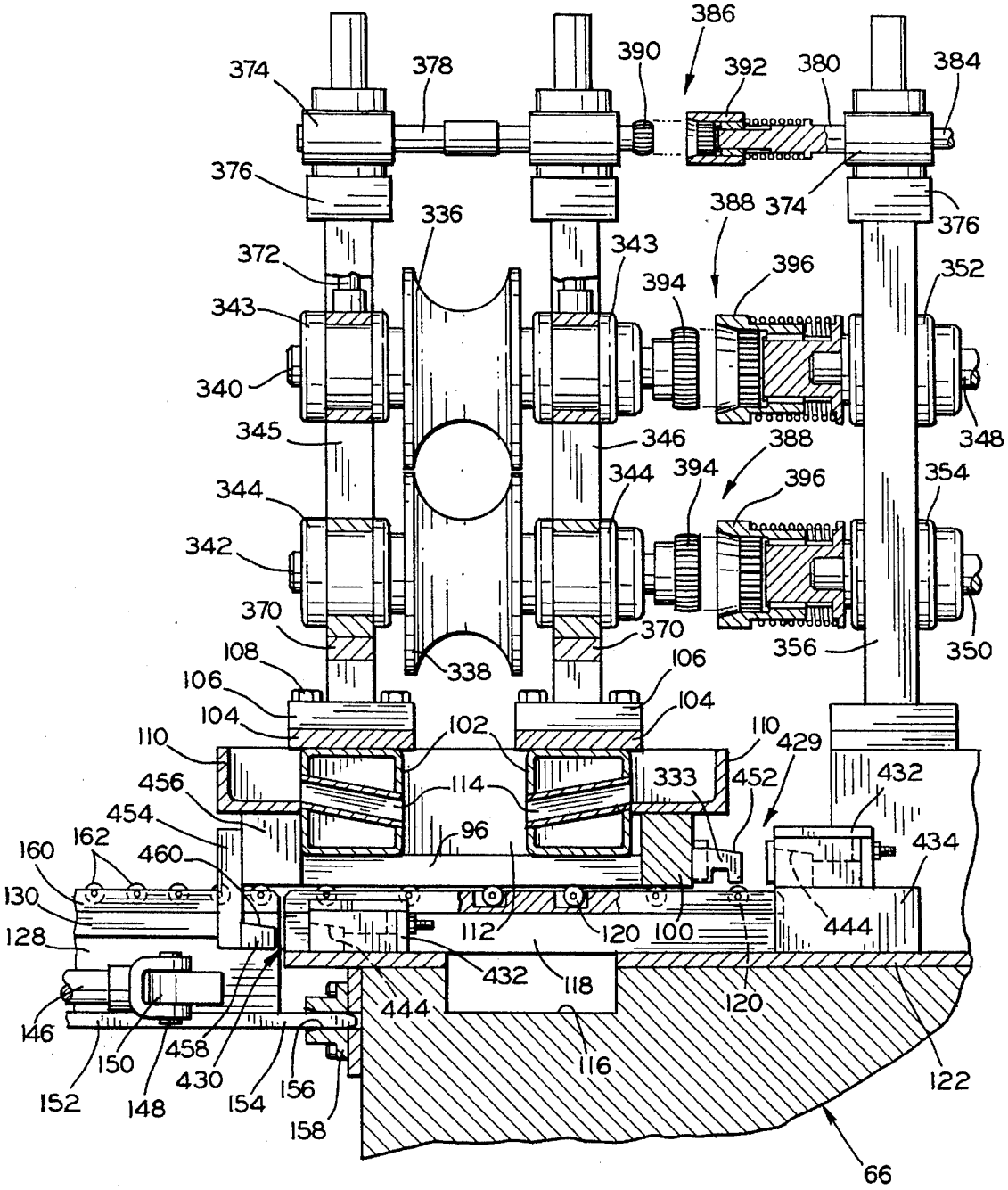
FIG. 4 is an end view, with parts in section, taken substantially along line 4—4 of FIG. 3 and showing a movable sub-base unit and driven mill stand slightly displaced from operating position.
Figure 14:
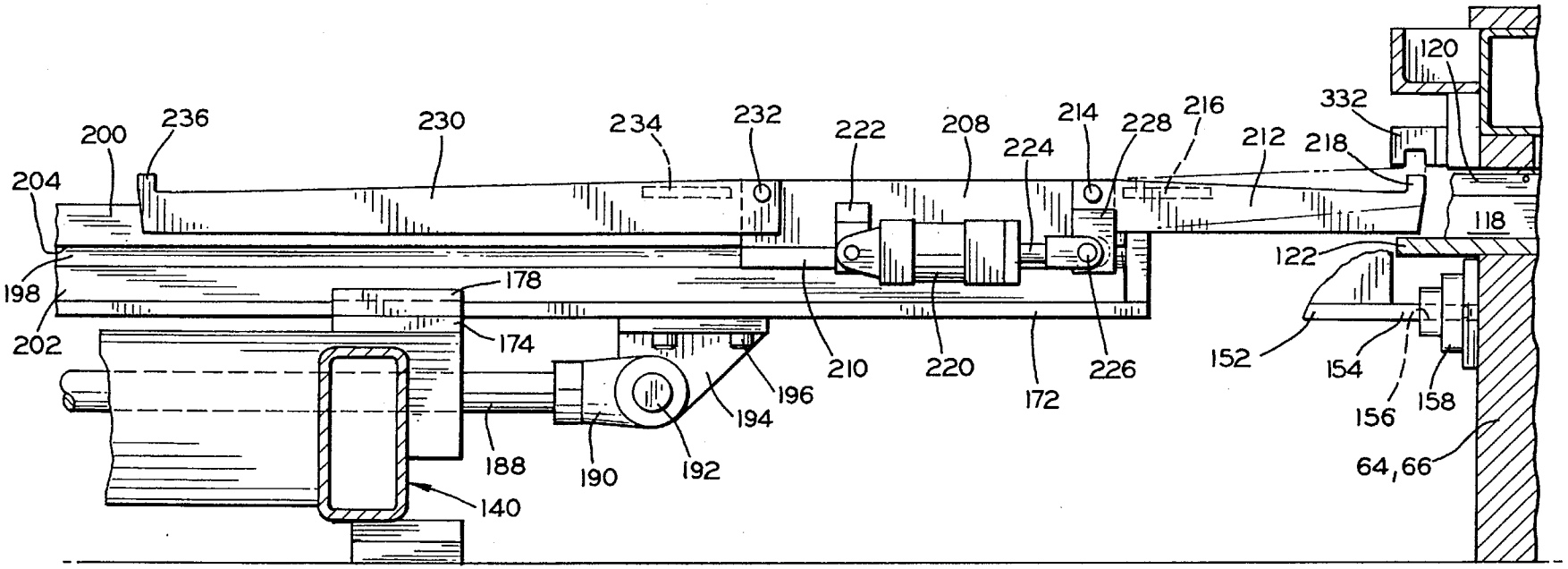
FIG. 14 is an elevational view, with parts in section, taken substantially along line 14—14 of FIG. 13.

In order to support the cantilevered end of the bridging arms in their extended position, there is provided beneath the beam 128 a plate 152 having an end or tongue 154 extending forwardly beyond the leading end of the beam a short distance. The tongue is adapted to be slidably received within a correspondingly shaped slot 156 of a support bracket 158 affixed to the appropriate mill base unit 64 or 66 (FIGS. 4 and 14). Thus, with the bridging arms 124 fully extended, their forward ends are firmly supported by the mill base units to bear the load as the sub-base units are moved between the transfer tables and mill base units.

Roller rails 16 having freely rotatably rollers 162 spaced therealong, are mounted atop the slide plates 130. With the bridging arms 124 fully extended and the tongues 154 received within the slots 156, the ends of the roller rails 160 are closely adjacent the ends of the roller rails 118, and the tops of the rollers 120 and 162 are substantially coplaner so as to provide a linear path along which inserts 164 in the runner bars 96 and 98 may ride in transporting the sub-bases.

One of the push-pull modules 126 is incorporated within each of the transfer tables 68, 70 and 72 to provide motive power for moving the related sub-bases between the mill bases, the transfer tables and the changeover racks. As best seen in FIGS. 12, 13 and 14, the push-pull modules include a box frame, identified generally at 166, upon which a carriage unit 168 is mounted for extension toward an adjacent mill base unit of the production facility. The box frame is formed of opposed channel sections 170 suitably affixed to the framework 140 of the transfer table and changeover rack.

The carriage unit 168 includes a base plate 172 whose marginal side edges rest upon wear plates 174 affixed to the top flanges 176 of the channel sections. Holders 178 affixed to the wear plates extend over the edges of the base plate and confine the base plate to reciprocating axial movement along the box frame 166. In order to extend and retract the carriage unit 168 as will be hereinafter described, a fluid actuated cylinder 180 is mounted within the box frame 166 beneath the base plate 172. An end of the cylinder is connected by means of a pin 182 between brackets 184 mounted upon a cross plate 186 affixed to the opposite channel members 170. As best seen in FIG. 14, the cylinder includes an extensible and retractable piston rod 188 which is connected by means of a coupling unit 190 and pin 192 to a bracket 194 affixed as by cap screws 196 to the base plate 172. Thus, by extending or retracting the piston rod the base plate and the carriage unit 168 thereon can be selectively axially advanced or retracted along the box frame 166.

The carriage unit 168, in turn, is adapted to advance and retract along the base plate 172 for suitably engaging and positioning related ones of the sub-bases. To that end, upstanding support plates 198 are mounted atop and extend along the base plate 172. Upper and lower retainer plates 200 and 202, respectively, extend along the outer faces of the support plates and define therebetween a longitudinally extending slot 204. The carriage unit 168 rides upon and is confined to reciprocating back and forth movement along the support and guide plates.

The carriage unit includes a top plate 206 which rides upon the edges of the support plates 198 and the upper retainer plates 200 for sliding back and forth movement therealong. Side retainer members 208 extend along the opposite side edges of the top plate and include inwardly directed foot members 210 adapted to project into the slots 204 for confining the carriage unit to sliding longitudinal movement along the carriage plates 198.

At the forward end of the carriage unit 168, that is, the end facing the mill base, spaced coupling arms 212 are mounted on the carriage unit for pivoting up and down movement about a shaft 214 extending through the opposite side retainer members 208. The coupling arms are interconnected by a cross bar 216 so as to pivot as a unit about the shaft. The arms are formed at their free end with upwardly directed fingers 218 for selectively engaging fixtures or hooks on the sub-base units as will be described. A fluid actuated cylinder 220 mounted by a bracket 222 upon one of the side retainer members 208, has a piston rod 224 connected by a pin 226 to an arm 228 affixed to one of the coupling arms 212 on the carriage unit. Thus by suitably extending and retracting the piston rod 224, the coupling arms 212 can be moved between the lowered, disengaged position shown in solid line in FIG. 14 and the raised, sub-base engaging position illustrated in broken lines.

In order to move the sub-base units between the transfer table and the changeover rack, the carriage unit 168 includes a second engaging mechanism extending rearwardly of the carriage unit for selectively engaging the sub-base units by means of fixtures or hooks disposed along their other longitudinal edge, that is, the edge opposite the mill base. The second mechanism is similar in construction to the above-described mechanism, and includes spaced coupling arms 230 mounted upon the carriage unit 168 for pivoting up and down movement about a shaft 232 extending through the side retainer members 208. The coupling arms are interconnected by a cross bar 234 and are formed at their distal ends with upwardly directed fingers 236 for selectively engaging hooks provided on the sub-base units as will be described. A second fluid actuated cylinder 238 is mounted upon the other of the side retainer members 208, and its piston rod 240 is connected by a pin 242 to an arm 244 affixed to one of the arms 230 on the carriage unit. Again, by selectively extending or retracting the piston rod 240 the arms 230 can be pivoted between lowered, rest and raised, sub-base engaging positions as desired.

Movement of carriage unit 168 along the carriage plates 198 and base plate 172 is provided by means of a lead screw 246 mounted between the carriage plates 198 and beneath the carriage unit (FIGS. 12 and 13). The lead screw is journalled for rotation at one end in a bearing unit 248 carried by the base plate and the carriage plates, and at the other end is mounted for rotation about its longitudinal axis by a motor and gear reduction drive unit 250 carried by the base plate 172. The motor and gear reduction unit is preferably of a suitably controlled conventional reversible hydraulically driven type. A drive collar 252 carried by a bracket 254 affixed to the underside of the top plate 206 (FIG. 13) surrounds and threadably engages the lead screw 246. As will be readily apparent, by rotating the lead screw the drive collar 252, and hence the carriage unit 168, may be caused to selectively move back and forth along the base plate 172.

As a sub-base unit is moved out of operative position on the mill base to the transfer table and the alternate sub-base unit is moved from the changeover rack to the mill base, it is necessary for one of the sub-base units to temporarily be shifted laterally onto the storage table. As heretofore described, the sub-base units ride upon rollers 162 in moving between the mill base and the changeover rack. In order to shift the sub-base unit laterally to and from the adjacent transfer table, lift units, identified generally at 256, are provided within the transfer table on either side of the push-pull module 126. As best seen in FIGS. 13 and 14, each lift unit comprises a generally rectangular framework including upstanding corner posts 258 interconnected by opposite cross members 260 and inverted side channel sections 262 extending across the tops of pairs of the corner posts. Roller pad units 264 are suitably secured to the channel sections atop the corner posts as by tap bolts 266. Lift units such as fluid actuated cylinders 268 are suitably supported upon the framework 140 and positioned at diametrically opposite corners of the lift unit framework. Piston rods 272 of the cylinders extend through and are affixed to the channel sections 262 as by collars 274. Thus by manipulating the cylinders to extend and/or retract the piston rods 272, the lift units 256 can be selectively raised and lowered to move the roller pad units 264 between the lowered or retracted position shown in solid lines and the elevated position as shown in broken lines in FIG. 13. When the lift units are raised, the rollers of the roller pad units rollingly engage the longitudinal runner bars 100 of the sub-base unit to lift the sub-base to the position shown in broken lines in FIG. 13 in preparation for transfer to the side storage table as will be hereinafter described.

Figure 15:
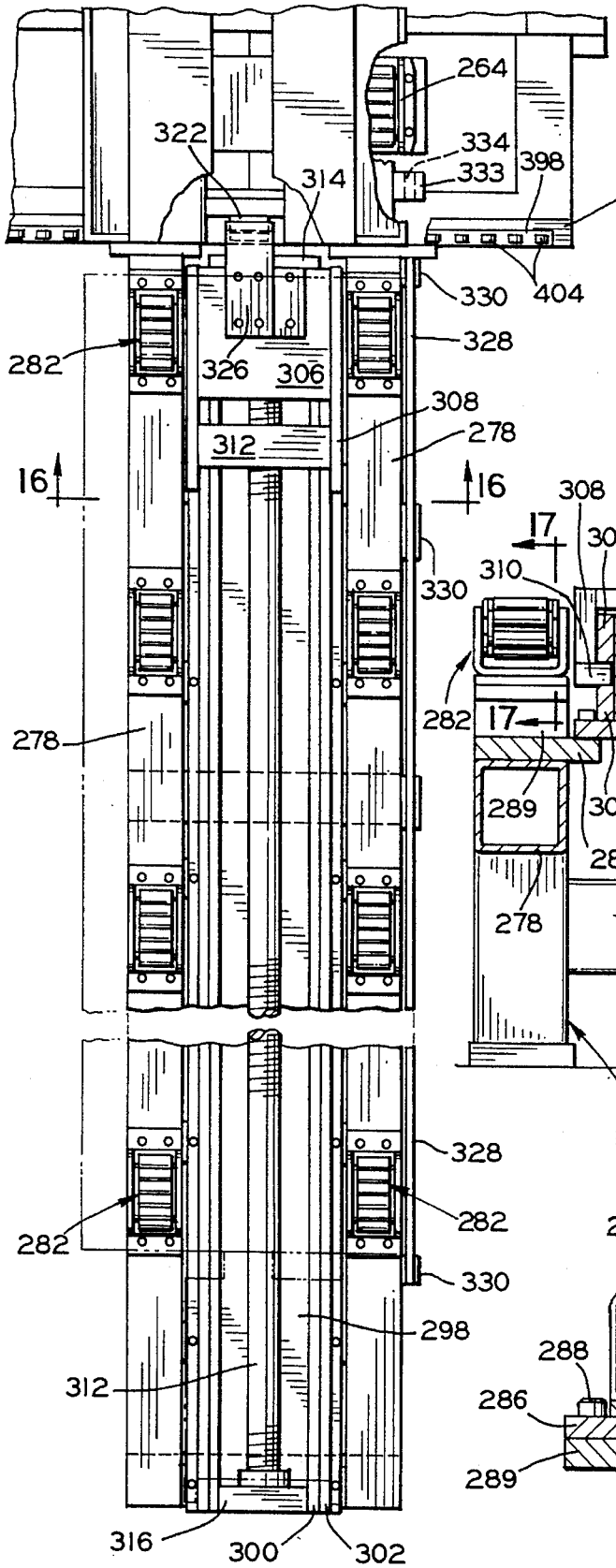
FIG. 15 is a top plan view of a side storage table section of the invention.
Figure 16:
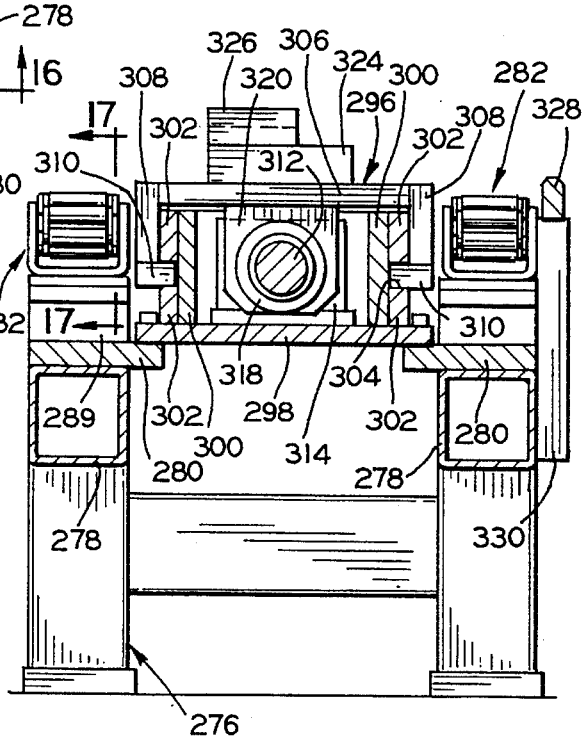
FIG. 16 is an enlarged vertical section taken substantially along line 16—16 of FIG. 15.
Figure 17:
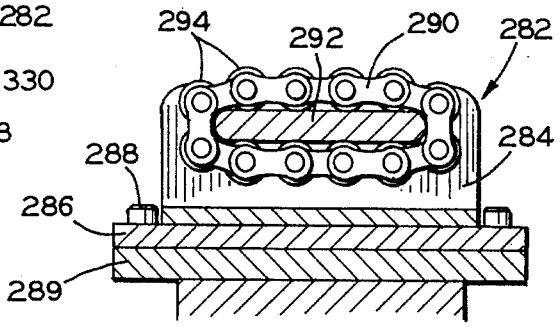
FIG. 17 is an enlarged fragmentary vertical section taken substantially along line 17—17 of FIG. 16.

The side storage tables 86, 88 and 90 are of generally similar construction, differing only in dimensions and configuration so as to be compatible with the particular one of the transfer tables 68, 70 and 72 with which they are associated. To that end each of the transfer tables, as best seen in FIGS. 15, 16 and 17, includes a support framework 276 incorporating spaced, longitudinally extending beams 278 upon which carrier plates 280 are mounted. Roller pad units 282, similar in construction to the roller pad units 264 and differing only in the shape of the mounting plates therefore, are mounted at spaced intervals along the carrier plates. The roller pad units may comprise a short channel section 284 affixed to a mounting plate 286. The mounting plate and channel section thereon are secured as by tap bolts 288 to an elevating stand 289 atop the carrier plate 280. A roller chain 290 is entrained about a support bar 292 affixed between the upstanding flanges of the channel section 284. Elongated rollers 294 of the roller chain rollingly support the sub-base on the support bars, and the roller chain travels thereabout as the sub-base is moved back and forth along the side storage table.

As illustrated in FIG. 13, the roller pad units 282 are mounted so that the rollers 294 are at the same elevation as the rollers of the roller pad units 264 in their raised position. Thus, with the lift units 256 and the roller pad units 264 in the raised position, the runner bars 100 of a sub-base will ride upon the rollers 294 of the roller pad units to permit the unit to be readily moved back and forth between the transfer table and the side storage table.

The side storage tables are provided with a push-pull carriage 296 similar to the carriage unit 168 of the push-pull module 126, for moving the sub-base unit back and forth between the transfer and storage tables. A base plate 298 suitably secured along its marginal edges to the carrier plates 280 carries a spaced pair of upstanding rail plates 300 which extend longitudinally throughout the length of the storage table guide plates 302 affixed to the outer faces of the rail plates define elongated slots 304 therebetween.

The push-pull carriage 296 comprises a carriage plate 306 extending across and riding upon the rail plates and guide plates. Edge members 308 extending along the carriage plate and downwardly over the upper guide plates 302 terminate in inwardly directed foot sections 310 extending into and slidable along the retaining slots 304. In order to lengthen the push-pull carriage for facilitating sliding movement along the rail and guide plates, the edge members and foot sections may extend beyond the end of the carriage plate 306, with the extensions being interconnected by a spacer bar 312 (FIG. 15). An elongated lead screw 312 extends throughout the length of the storage table beneath the carriage plate. At one of its ends the lead screw is drivingly coupled to a reversible motor and gear reduction unit 314 mounted upon the base plate 298. At its other or distal end the lead screw is journalled for rotation in a bearing assembly 316 mounted between the rail plates 300. A threaded collar 318 surrounding and in threaded engagement with the lead screw 312 is mounted within a bracket 320 affixed to the carriage plate 306. Thus by selective operation of the motor and gear reduction unit 314, the threaded collar and push-pull carriage 296 connected thereto can be caused to move back and forth along the lead screw.

The push-pull carriage is adapted to be releasably connected to a sub-base unit for pulling the sub-base unit from the transfer table onto the side storage table and thereafter pushing it back onto the transfer table. To that end as will be seen in FIGS. 13 and 15, an upwardly facing hook member 322 is suitably affixed to the framework of the sub-base unit. A hook unit 324 having a hook extension 326 adapted to matingly engage the hook unit 322 is affixed to the carriage plate 306. Thus as will be seen in FIG. 13, with the sub-base in the lowered, solid line position the push-pull carriage 296 is maneuvered into position adjacent the transfer table, with the hook extension 326 over the hook 322. The sub-base unit is then raised by the lift units 256 to the broken line position, whereat the hook members 322 and 326 interlock so that the push-pull carriage 296 can move the sub-base unit along the transfer table and the storage table on the roller pad units 264 and 282.

In order to maintain the sub-base unit in alignment with the storage table as it moves therealong, a guide rail 328 is mounted upon the framework 276 as by posts 330 so as to extend along the edge of the table. Hooks 332 affixed to the sub-base unit at spaced intervals along opposite sides for engagement by the fingers 218 and 236 of the push-pull units, and hold down fixtures 333 also affixed to the sub-basic unit, include slots 334 adapted to slidingly receive the guide rail for guiding the sub-base as it moves along the storage table.

In order to facilitate automation of the changeover from one set of sub-base units to another and to minimize the time required for the changeover, the driven mill units are connected to the drive systems 92 and 94 by means of separable self-aligning couplings. As best seen in FIG. 4, wherein a sub-base unit mounting driven forming elements is shown slightly displaced from operating position, a stand incorporating driven forming components typically comprises a pair of cooperating forming rolls 336 and 338 carried by shafts 340 and 342. The shafts are suitably journalled by bearing units 343 and 344 in spaced upright stanchions 345 and 346 affixed to the base plates 106. The rolls 336 and 338, or other forming tools of each stand, are driven by power takeoff shafts 348 and 350, respectively, journalled in bearing blocks 352 and 354 suitably mounted in an adjacent stand 356. The stand is fixedly mounted upon the appropriate one of the mill bases 64 and 66. The power takeoff shafts are coupled through universal joints 358 to output shafts 360 of right angle gear boxes 362 mounted upon the base units 64 and 66. The gear boxes are drivingly coupled through line shafts 364 and variable speed control units 366 to drive units 368 (FIG. 1) for the drive systems 92 and 94 such as a suitable electric or hydraulic motors.

The rolls 336 and 338 or other tube forming elements will, of course, be of different diameters for forming tubing of different sizes. Consequently, in operative position the elevation of the upper roll 336 and its shaft 340 and bearing unit will differ for different forming element configurations. Provision is thus made for moving the bearing units 343 to selected vertical positions within the upright stanchions 345 and 346. As will be seen in FIGS. 2 and 4, the stanchions include spaced pairs of legs 345 *a* and 345 *b* and 346 *a* and *b*, respectively, between which the bearing units 343 and 344 are mounted for sliding up and down movement. The bearing units 344 are seated in fixed position against a base member 370 which can be provided with shims (not shown) so that the shaft 342 remains at a constant elevation.

The upper bearing units 343 are operably connected by jack shafts 372 to screw jack units 374 mounted upon plates 376 atop the legs of the stanchions. The screw jack units are interconnected for simultaneous operation by an operating shaft 378 which, in turn, is adapted to be coupled to an output shaft 380 from an additional one of the screw jack units 374 affixed to a plate 376 on the stand 356. The bearing blocks 352 and 354 are mounted within the stand 356 for vertical sliding movement in a manner similar to the mounting of the bearing units 343 and 344 within the stanchions 345 and 346. The additional screw jack unit 374 is connected to the bearing block 352 by a jack shaft (not shown), and the additional screw jack unit is connected to a suitably controlled reversible motor and gear reduction drive unit 382, mounted on the plate 376 (FIGS. 2 and 3) by a drive shaft 384.

By operation of the drive unit with the sub-base in operative position on the mill base unit and the operating shaft 378 coupled to the output shaft 380 as will be hereinafter described, the three screw jack units 374 will be operated simultaneously to raise or lower the bearing units 343 and the bearing block 352 in unison. The bearing units and the bearing block and their associated shafts 340 and 348, respectively, can thus be maintained in axial alignment to facilitate automatic coupling and subsequent operation of the shafts upon changing of the sub-base units on the mill base.

In order to provide for automatic coupling and uncoupling, the operating shaft 378 is connected to the output shaft 380 and the shafts 340 and 342 are connected to the power takeoff shafts 348 and 350, respectively, by means of conventional self-aligning separable couplings identified generally at 386 and 388 (FIG. 4). As will be seen in FIG. 4, wherein the sub-base unit is illustrated slightly displaced from operating position on the mill base, the coupling 386 comprises a toothed male gear unit 390 having a rounded surface on the end of the operating shaft 378. A mating spring-loaded female receptacle 392 is provided on the output shaft 380 for axially receiving the toothed male unit in driving relationship. The coupling 388 is of similar construction and includes toothed male gear units 394 on the shafts 340 and 342 for mating with female units 396 affixed to the power takeoff shafts 348 and 350.

In addition to the roller rails 160 carried by the slide plates 130 for carrying the sub-bases from the mill bases to the transfer tables and laterally across the transfer tables, roller rail units 398 are mounted upon intermediate and end base members 400 and 402, respectively (FIGS. 12 and 13), affixed to the framework 140 of the transfer tables and changeover racks. The roller rail units carry freely rotatable rollers 404 upon which the inserts 164 are adapted to ride in positioning the base units upon the transfer tables and changeover racks. A guide bar 406 affixed to the base member 400 and extending along side the roller rail unit 398 is adapted to be slidingly received within an elongated recess 408 in the underside of the combined runner and guide bar 98 for maintaining the sub-base units in proper alignment as they are positioned on the transfer tables and the changeover racks. Upstanding stop members 409 are affixed to the framework 140 along the rear of the changeover rack for limiting rearward movement of the sub-bases thereon.

It is, of course, necessary for proper operation of the mill that the sub-base units be precisely located and securely affixed in predetermined positions upon the mill base following the automated changeover sequence. To that end as will be seen in FIGS. 3 and 5 to 8, guide rail units 410 are mounted upon the bed plates 122 of the mill base units as by cap screws 412. The guide rail units are aligned with the corresponding guide bars 406 on the transfer tables and changeover racks, and are likewise adapted to be slidingly received within the recesses 408 of the sub-base units.

Figure 5:
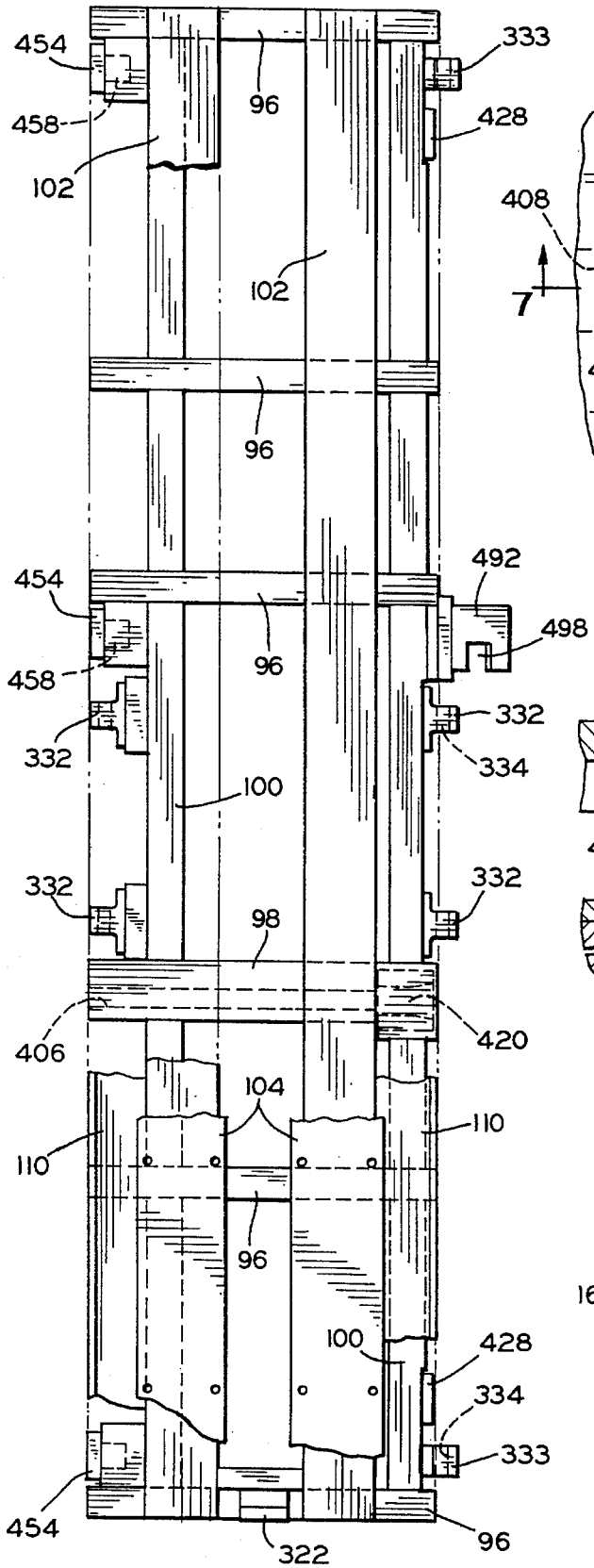
FIG. 5 is a top plan view of a movable sub-base section, with parts broken away for purposes of clarity.
Figure 6:
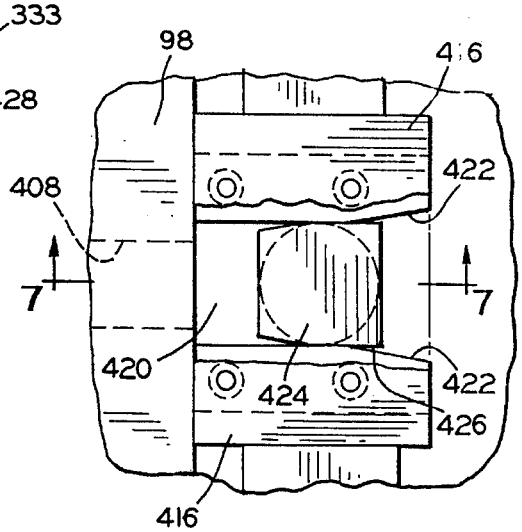
FIG. 6 is an enlarged fragmentary top plan view, with parts broken away, of mechanism for aligning a sub-base unit with the mill base.
Figure 7:
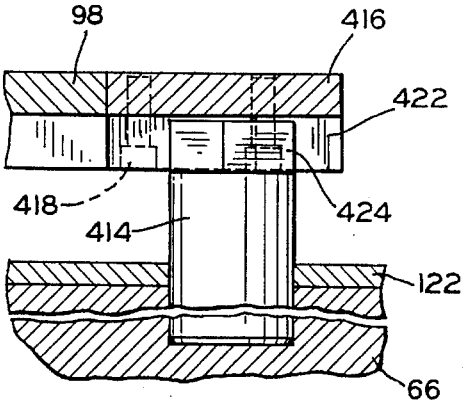
FIG. 7 is a vertical elevation, partially in section, taken substantially along line 7—7 of FIG. 6.
Figure 8:
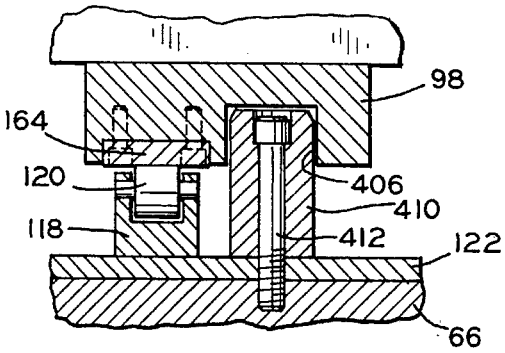
FIG. 8 is a vertical section taken substantially along line 8—8 of FIG. 3.

In order to precisely laterally position the sub-bases as they are advanced into operative position, a locating post 414 is seated within the mill base unit and extends upwardly beneath the sub-base unit. Spaced guide plates 416 are affixed to the underside of the runner and guide bar 98 as by cap screws 418 so as to define therebetween a channel 420 which is an extension of the recess 408. The channel 420 is somewhat wider than the recess 408 and, at the forward end, its opposite side wall 422 diverge outwardly (FIGS. 5 and 6).

The locating post 414 is provided with a cap 424 having opposite side walls 426 which converge in the direction of the sub-base unit. Thus, as a sub-base unit is moved across the bridging units to the mill base the diverging sidewall 422 of the channel 420 will align the sub-base unit with the guide rail unit 410, and will then cooperate with the angularly disposed sidewalls of the cap 424 to precisely position the sub-base unit along the mill base as the sub-base unit is seated in operative position (FIG. 6). Abutment stands 427 affixed to the mill base framework (FIG. 3) engage abutment plates 428 on the framework of the sub-base unit adjacent either end thereof (FIG. 5) to properly align the sub-base unit along the longitudinal axis of the mill.

Figure 11:
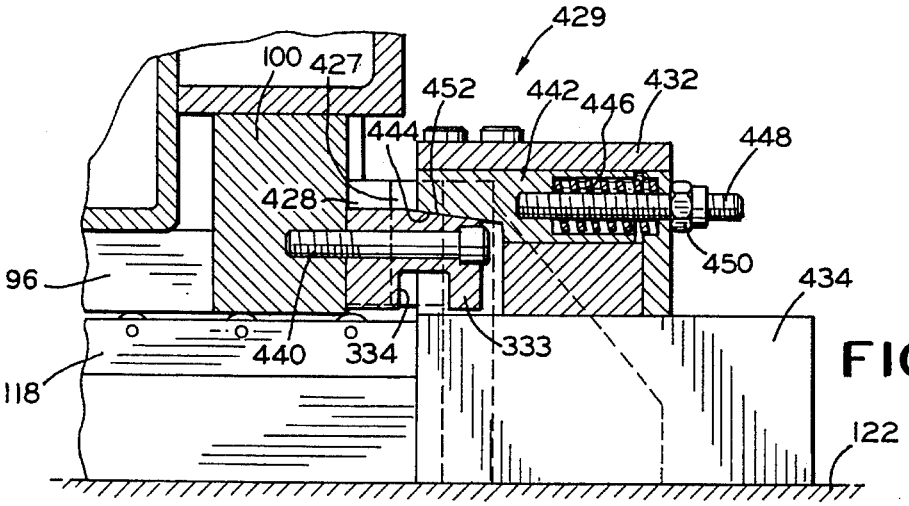
FIG. 11 is an enlarged fragmentary vertical section through a hold down device for the sub-base units, taken substantially along line 11—11 of FIG. 3.

It is important that the sub-base units be secured to the mill base so as to remain in a fixed, predetermined position during extended periods of mill operation. To that end as best seen in FIGS. 4, 5 and 11, spring lock devices, identified generally at 429 and 430, are provided at spaced locations along opposite longitudinal sides of the sub-base and mill base units. More particularly, the spring lock device 429 comprise female units 432 suitably affixed to mounting blocks 434 on the bed plate 122. Mating male units 436 affixed to the longitudinal runner bar 100 of the sub-base unit as by cap screws 440, are adapted for axial insertion into the female units.

The female unit comprises a spring-loaded plunger member 442 mounted for sliding axial movement within the housing of the unit. The plunger member includes a downwardly facing bevelled surface 444. A compression spring 446 surrounds a threaded adjusting bolt 448 extending through the rear wall of the housing and into the plunger 442. The compression spring acts between the rear wall of the housing and the end of the plunger 442 to urge the plunger toward an extended position. A fastener 450, such as a friction nut, may be adjustably moved along the adjusting bolt 448 to selectively adjust the maximum extension of the plunger unit. The male unit 446 is adapted to be received within the female unit 432 as the sub-base is moved into operative position by the push-pull unit. A sloping top surface 452 of the male unit slidingly engages the mating bevelled surface 444, and the plunger is urged rearwardly against the compression spring 446 as the sub-base advances. In its fully advanced position as shown in FIG. 11, the end of the male unit is slightly spaced from the base of the female unit. Thus as will be readily apparent, the spring loaded plunger will maintain engagement with the male unit and securely hold down the sub-base unit.

The spring locks on the opposite side of the sub-bases are similar in construction and function to the device 428. The female unit 432 of the spring lock device 430 is mounted on the bed plate 122 so as to permit the sub-base unit to pass thereover. A mating L-shaped male hook 454 affixed to a mounting block 456 carried by the sub-base framework, includes a finger 458 having a sloping top surface 460 cooperable with the bevelled surface 444 to hold the sub-base unit down.

Figure 3:
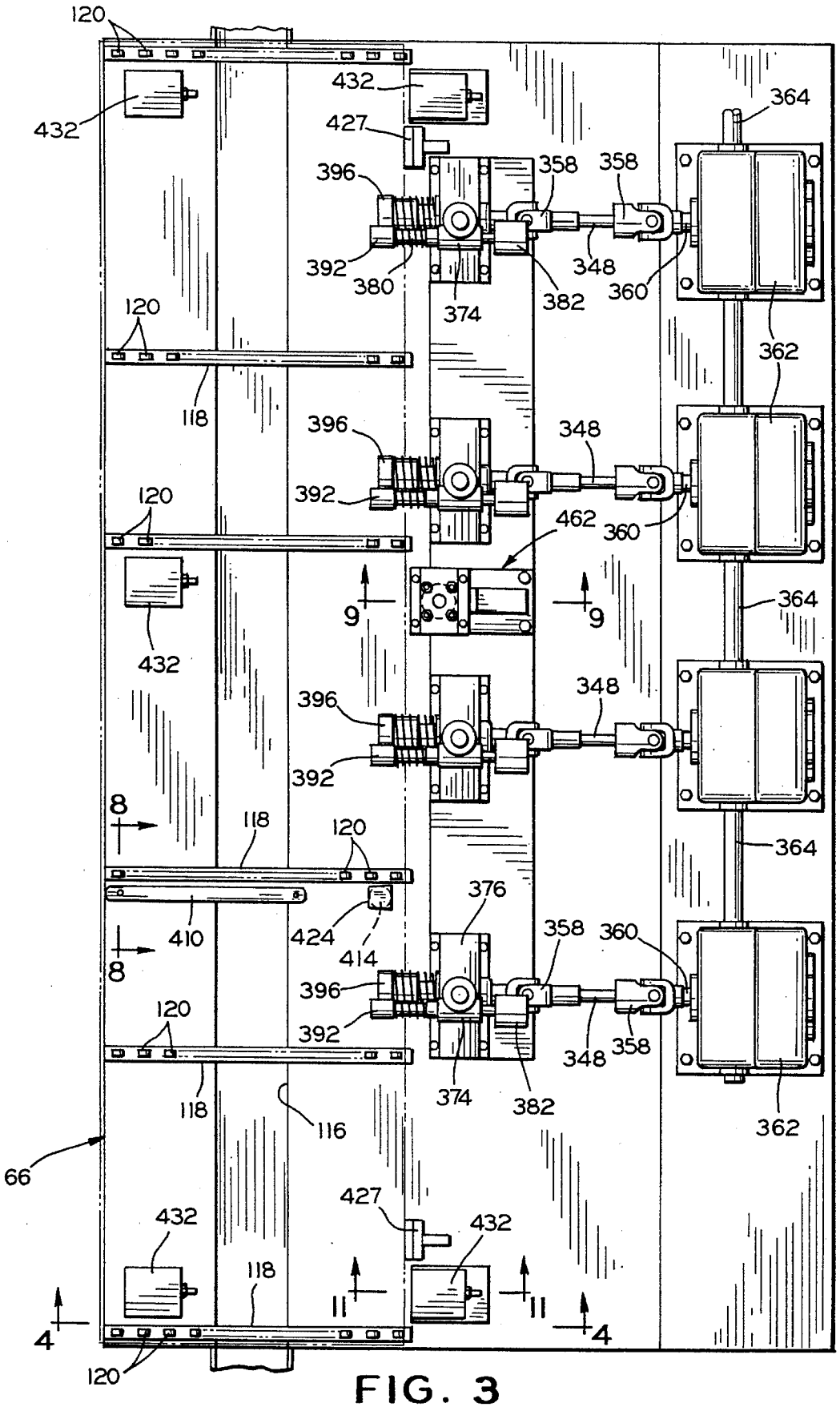
FIG. 3 is a top plan view of a mill base section absent the sub-base unit, and illustrating the mill drive gear boxes and female coupling sections.
Figure 9:
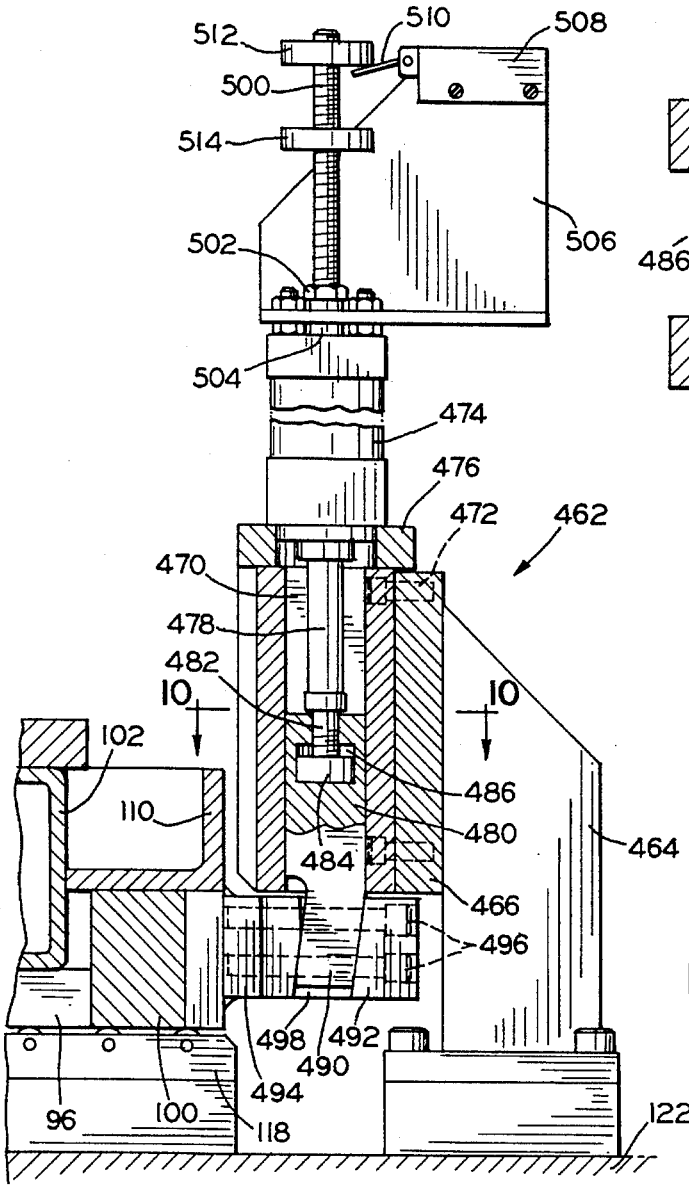
FIG. 9 is an enlarged fragmentary section of a locking device for the sub-base units, taken substantially along line 9—9 of FIG. 9.
Figure 10:
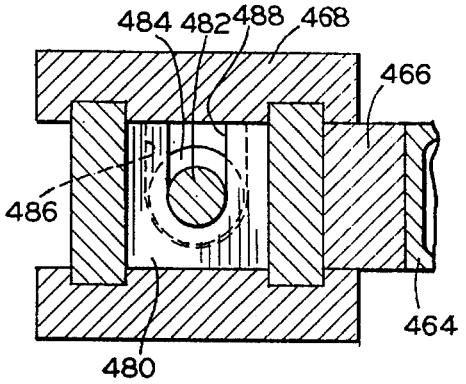
FIG. 10 is a horizontal section taken substantially along line 10—10 of FIG. 9.

The sub-base units are secured in operative position upon the mill base with the abutment plates 428 urged against the abutment stands 427 and with the male and female portions of the spring lock devices 429 and 430 in engagement, by a wedge lock unit, identified generally at 462. As best seen in FIGS. 3, 5 and 10, the wedge lock unit comprises a stand 464 suitably secured upon the bed plate 122 of the mill base, and including an upstanding mounting bar 466. A elongated box-like structure 468 comprised of opposite side and end walls defining a slideway 470 extending longitudinally therethrough, is affixed to the mounting bar as by cap screws 472. A fluid operated cylinder 474 is mounted atop the structure 468 by a mounting ring 476. The cylinder includes a downwardly extending piston rod 478 coupled to the piston (not shown) within the cylinder for suitably controlled extension and retraction. A slide member 480 positioned within the slideway 470 for reciprocating back and forth movement is operably connected to the piston rod. As seen in FIGS. 9 and 10, the connection between the piston rod and the slide member may comprise a threaded extension 482 on the end of the piston rod to which a disc 484 is affixed. The disc is received within an open-sided cavity 486 in the slide member, and the extension 482 extends through an open sided throat 488 of reduced width so that when the slide member 480 is disposed within the slideway 470, the disc is captured within the cavity 486.

A wedge finger 490 extends downwardly from the main body of the slide member 480 at an angle to the longitudinal axis of the slideway 470 and the slide member 480. A latch 492 is affixed to a plate 494 on the sub-base of the framework as by cap screws 496. An open sided recess 498 extending through the latch at an angle similar to that of the wedge finger is adapted to matingly receive the wedge finger. As will be apparent in FIG. 9, as a sub-base unit arrives at a position just short of operating position during a changeover procedure, the retracted slide member 480 is extended by the piston rod 478. The wedge finger 490 enters the recess 498 and as it advances, bears against the sloping walls of the recess to urge the sub-base toward the right into operative position, with the abutment plates 428 bearing against the abutment stands 427 and the male and female units of the spring lock devices 429 and 430 engaged. Conversely, during a changeover procedure retraction of the slide member and wedge finger will urge the latch 492 toward the left and, along with the spring loaded plunger members 442 of the spring lock devices 429 and 430, unseat the sub-base unit from operative position so that it can be readily retrieved by the push-pull unit.

For operating purposes a threaded control rod 500 extends from the end of the cylinder 474 opposite the piston rod 478 and is operatively coupled to the piston (not shown) of the cylinder for axial movement therewith. A nut 502 adjustably positionable along the control rod is adapted to engage the end of a sleeve 504 extending from the cylinder for limiting the downward movement of the piston within the cylinder, and hence the projection of the wedge finger into the recess 498. A bracket 506 mounted atop the cylinder carries a dual acting or reversing limit switch 508 having an operating arm 510. Spaced actuator discs 512 and 514 adjustably positionable along the control rod engage the operating arm as the control rod moves up and down with the piston rod to activate the limit switch and regulate the length of travel of the slide member 480 and wedge finger 490 thereon.

Figure 18:
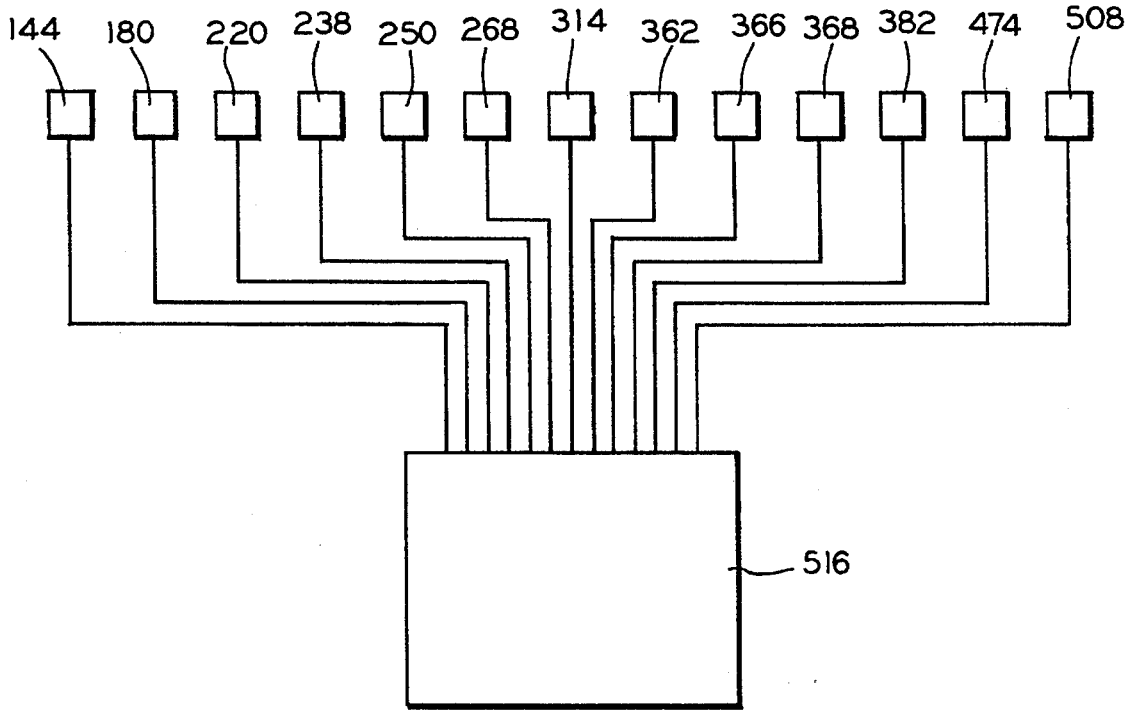
FIG. 18 is a diagram schematically illustrating the programmable controller and the activating units operably connected thereto through suitable controls.

While the various components may obviously be manually operated in sequence to change the mill over from production of one product to another, in order to utilize the invention to its fullest advantage it is preferred that the changeover procedure be automated. To that end as illustrated schematically in FIG. 18, there is provided a programmable controller 516 to which controls for the operating devices of the various components of the system 20 are operably coupled. The controller is conventionally programmed so as to, upon an initiating signal, sequentially operate the various components as necessary to remove a set of sub-base units from the mill base to the changeover racks and to transfer an alternate set of prepared previously sub-base units from the changeover racks into position ready for operation on the mill bases.

In reviewing briefly operation of the invention, it will be understood that while the invention is ideally adapted to automated control of the sequential steps involved in the changeover procedure, the procedure may as well be performed by manual control of the various components in sequence. In either event the changeover is begun by discontinuing feeding of the strip or skelp 22 into the mill and clearing the previously manufactured tube from the mill. All mill mounted operator guards which may be provided (not shown), preferably of an overhead retractable type, are removed or retracted. The guards may be provided with an interlock system so that the mill will not operate if the guards are not in the lowered, protective position and the changeover procedure may not proceed if the guards are not in the retracted position.

All of the driven mill stand upper spindles including the separable couplings 386 and 388 and the equipment mounting the shafts 378 and 380 and 340 and 348, respectively interconnected thereby, are raised to their full up positions. The male and female sections of the separable couplings will thus always be in proper alignment for recoupling automatically as the replacement sub-base unit is moved into operative position.

Safety gates such as retractable overhead units (not shown) may be provided to insure that personnel do not enter the operator's work area between the mill and the changeover equipment during the changeover operation. Suitable interlocks may be included to insure that the safety gates are in place prior to initiating the changeover operation. The changeover sequence is then initiated, with the transfer table bridging roll sections 80, 82 and 84 and their associated push-pull modules 126 being extended to the mill mounted sub-bases 24, 26 and 30. When the push-pull modules arrive at the sub-bases and the bridging roll sections engage the mill bases, the coupling arms 212 are raised so that the fingers 218 engage the hook fixtures 332 on the sub-base units. The wedge lock units 462 then are retracted, disengaging the wedge fingers 490 and the spring lock devices 429.

The carriage units 168 of the transfer table push-pull modules are retracted, transferring the sub-base units from the mill bases onto the transfer tables. The coupling arms of the transfer table push-pull modules are disengaged from the sub-base units. The side storage table push-pull carriages 296 are moved to engaging position, and the transfer table lift units 256 are raised to lift the sub-base units and couple the hooks 322 and hook extensions 326. The push-pull carriages are retracted, transferring the sub-bases onto the side storage tables 86, 88 and 90. The transfer table lift units 256 are lowered to their retracted position.

The carriage units of the transfer table push-pull modules are moved into position so that upon raising of the rear arms 230 the fingers 236 engage the fixtures 332 along the back sides of the alternate sub-base units on the changeover racks 74, 76 and 80. The push-pull modules are then retracted, transferring the alternate sub-bases to the transfer tables. The arms 230 are lowered to disengage the fingers 236, and the push-pull modules are repositioned to couple the arms 212 to the fixtures 332 along rear edges of the sub-bases. Thereafter the transfer table push-pull modules are extended to transfer the alternate sub-bases to the mill bases.

As the alternate sub-bases move into position upon the mill bases, the male and female sections of the spring loaded separable coupling units 386 and 388 will operably interconnect and the sub-bases will be aligned by locating post 414 and the guide plates 416. The wedge lock units 462 are actuated to lower the wedge finger 490 and lock the alternate sub-bases in operative position. The transfer table push-pull modules are then disengaged, and both the push-pull modules and the bridging roll units are retracted.

The removed sub-base units, positioned on the side storage tables, are then transferred to the changeover racks for retooling as convenient. To that end the lift units 256 carrying the rollers 294 are raised and the side storage push-pull carriages 296 are extended to transfer the sub-bases endwise onto the transfer tables. The lift units are lowered, depositing the sub-bases onto the roller rail units of the transfer tables. The transfer table push-pull modules are then coupled to the sub-bases, and the modules are appropriately extended to transfer the sub-bases onto the changeover racks. The push-pull modules are disengaged from the sub-bases and retracted to their storage positions. Finally, the driven mill stand upper spindles are lowered and adjusted into operative position, the protective safety gates are repositioned, and the mill is ready for threading and start-up. The removed sub-base units are in position for off-line changeover and retooling as appropriate.

Of course, as will be readily appreciated, in performing the changeover procedure the alternate sub-bases may first be transferred from the changeover racks to the transfer tables and then the side storage tables. The removed sub-base units can then be transferred directly from the mill bases to the changeover racks.

It is to be understood that the forms of the invention herewith shown and described are to be taken as illustrative embodiments only of the same, and that various changes in the shape, size and arrangement of parts, as well as various procedural changes, may be resorted to without departing from the spirit of the invention.

What is claimed is:

1. A continuous tube mill apparatus adapted for quick changeover from production of a first product to production of a second product of a different size or shape, the tube mill comprising a mill base upon which a series of forming units is operably carried for progressively forming a skelp into the finished product, a first sub-base unit upon which forming units for forming the first product are mounted, the sub-base unit being rollingly supported to enable the same to be removably mounted upon the mill base, a changeover module positioned beside and spaced from the mill base, a second duplicate sub-base unit having forming units thereon for forming the second product movably positioned upon the changeover module, bridging means selectively extendable from the changeover module to the mill base, said bridging means comprising a spaced pair of arms having rollers thereon for rollingly supporting the sub-base units for movement between the mill base and the changeover module, and means for removing the first sub-base unit from the mill base across the bridging means to the changeover module and the second sub-base unit from the changeover module across the bridging means into operative position on the mill base.

2. A continuous tube mill apparatus as claimed in claim 1, wherein the changeover module includes roller means mounted thereon for rollingly supporting the sub-base units for movement onto and away from the bridging arms.

3. A continuous tube mill apparatus as claimed in claim 2, including a push-pull module incorporated in the changeover module, the push-pull module including means for engaging a sub-base unit on the mill base and pulling the sub-base unit across the bridging arms from the mill base onto the changeover module.

4. A continuous tube mill apparatus as claimed in claim 3, wherein the means for engaging a sub-base unit includes a pair of spaced coupling arms pivotably mounted upon the push-pull module, finger means on each coupling arm, mating fixtures on the sub-base units adapted to be engaged by the finger means, and means for pivoting the coupling arms to selectively engage and disengage the finger means and fixtures.

5. A continuous tube mill apparatus as claimed in claim 4, wherein the means for engaging a sub-base unit includes two of the pairs of spaced coupling arms, the pairs of coupling arms facing in opposite directions on the push-pull module, the sub-base units having opposite longitudinal sides, with mating fixtures along each longitudinal side adapted to be engaged by the finger means of the pairs of coupling arms.

6. A continuous tube mill apparatus as claimed in claim 1, including lock means for releasably holding a sub-base unit downwardly in engagement with the mill base with the sub-base in operative position on the mill base, said lock means comprising a male unit mounted on the sub-base unit and a mating female unit mounted on the mill base for receiving the male unit in a hold-down relationship as the sub-base moves into operative position on the mill base.

7. A continuous tube mill apparatus as claimed in claim 6, including wedge lock means for releasably securing a sub-base unit in operative position upon the mill base, said wedge lock means comprising a latch member mounted upon the sub-base unit, wedge finger means mounted on the mill base for reciprocating movement into and out of engagement with the latch member, and means for selectively advancing and retracting the wedge finger means whereby upon advancement of the wedge finger means into engagement with the latch member the male and female units of the lock means are urged into hold-down relationship and the sub-base is urged into engagement with abutment members on the mill base to secure the sub-base against lateral movement.

8. A continuous tube mill apparatus as claimed in claim 1, including a locating member upon the mill base, and a guide unit upon the sub-base unit adapted to receive the locating member for laterally shifting the sub-base unit into a predetermined position upon the mill base as the sub-base unit is moved into operative position upon the mill base.

9. A continuous tube mill apparatus as claimed in claim 1, including drive means for at least some of the forming units, the drive means including a drive stand mounted upon the mill bases within which a drive shaft is journalled for rotation, the forming units including a forming stand mounted upon the sub-bases and carrying a forming tool mounted upon a shaft journalled for rotation within the forming stands, and a self-aligning coupling means for separably connecting the shaft of the forming tool to the drive shaft.

10. A continuous tube mill apparatus as claimed in claim 9, wherein said self-aligning coupling means comprises a female unit upon the drive shaft adapted to axially drivingly receive a toothed male unit upon the shaft of a forming tool.

11. A continuous tube mill apparatus as claimed in claim 10, wherein the forming stands carry cooperating upper and lower forming tools mounted in vertical alignment, and including means for simultaneously selectively raising and lowering the upper one of the cooperating forming tools within the forming stand and the drive shaft for the upper forming tool.

12. A continuous tube mill apparatus as claimed in claim 11, wherein the changeover module comprises a transfer table, with the bridging means extendable from the transfer table to the mill base, a changeover rack along the side of the transfer table opposite the mill base, a side storage table extending from an end of the transfer table, roller support means upon the transfer table and changeover rack for rollingly supporting the sub-base units during transfer between the transfer table and the changeover rack and means for moving sub-base units laterally back and forth between the transfer table and the side storage table and between the transfer table and the changeover rack wherein the transfer table includes elevating stands for raising a sub-base unit above the transfer table, the elevating stands comprising lifting roller members adapted to engage and lift the sub-base unit from the transfer table and rollingly support the sub-base unit for endwise movement onto the side storage table, and means for selectively raising and lowering the lifting roller members.

13. A continuous tube mill apparatus as claimed in claim 12, wherein the side storage table includes roller means mounted to rollingly carry the sub-base units between the transfer table and the side storage table with the lifting roller members in their raised position, and a push-pull module adapted to engage sub-base units and transfer the sub-base units back and forth between the transfer table and the side storage table.

* * * * *